US008156585B2

(12) United States Patent
Medici

(10) Patent No.: US 8,156,585 B2
(45) Date of Patent: Apr. 17, 2012

(54) BEDDING DESIGN

(76) Inventor: Jonathan Medici, San Ramon, CA (US)

( * ) Notice: Subject to any disclaimer, the term of this patent is extended or adjusted under 35 U.S.C. 154(b) by 0 days.

(21) Appl. No.: 12/878,198

(22) Filed: Sep. 9, 2010

(65) Prior Publication Data

US 2012/0060282 A1 Mar. 15, 2012

(51) Int. Cl.
*A47G 9/02* (2006.01)

(52) U.S. Cl. ..... 5/495; 5/502; 5/497

(58) Field of Classification Search ..... 5/502, 495, 5/497

See application file for complete search history.

(56) References Cited

U.S. PATENT DOCUMENTS

| | | | | |
|---|---|---|---|---|
| 5,042,098 | A * | 8/1991 | Stultz | 5/495 |
| 5,515,799 | A * | 5/1996 | Heptner | 112/475.08 |
| 6,286,162 | B1 * | 9/2001 | Huart | 5/482 |
| 6,389,621 | B1 * | 5/2002 | Elliott et al. | 5/497 |
| 6,427,266 | B2 * | 8/2002 | Talley-Williams | 5/482 |
| 7,487,561 | B2 * | 2/2009 | Ho | 5/497 |
| 2007/0000053 | A1 * | 1/2007 | Yang | 5/493 |
| 2007/0271699 | A1 * | 11/2007 | Sacchetti | 5/495 |
| 2008/0034500 | A1 * | 2/2008 | Costello | 5/485 |
| 2008/0104751 | A1 * | 5/2008 | Friedland | 5/502 |
| 2008/0115271 | A1 * | 5/2008 | Wiley | 5/497 |
| 2008/0256707 | A1 * | 10/2008 | Bank | 5/485 |
| 2009/0013467 | A1 * | 1/2009 | Moorhouse | 5/496 |
| 2009/0070933 | A1 * | 3/2009 | Hall | 5/496 |
| 2009/0178197 | A1 * | 7/2009 | Swihart et al. | 5/496 |
| 2009/0205133 | A1 * | 8/2009 | Thomas | 5/485 |
| 2009/0265855 | A1 * | 10/2009 | Hawk | 5/655 |

* cited by examiner

*Primary Examiner* — Robert G Santos
*Assistant Examiner* — Brittany Wilson
(74) *Attorney, Agent, or Firm* — Lyman H. Smith

(57) ABSTRACT

A bedding design enables a user to fold a portion of the bedding underneath itself to create a pouch. The pouch may provide warmth for a user's feet and lower legs when they are lying in bed. The bedding may include a comforter with optional sheets and/or blankets. The additional sheets and/or blankets may be folded in a similar manner, either separately or together with the comforter. The comforter may be designed with an additional flap attached thereto so that folding the flap to create the pouch does not change the appearance of the bedding on a bed.

12 Claims, 3 Drawing Sheets

BEDDING DESIGN

BACKGROUND OF THE INVENTION

The present invention relates to bedding and, more particularly, to a comforter and sheet/blanket design that may increase warmth for a person's feet and lower legs when needed.

Current bedding is designed to uniformly cover the bed. If additional warmth is desired for one's feet or lower legs, an additional blanket is used. The position of the additional blanket may shift during the night, requiring repositioning and disrupting a person's sleep.

As can be seen, there is a need for bedding that may provide increased warmth for a person's feet and lower legs.

SUMMARY OF THE INVENTION

In one aspect of the present invention, a bedding system comprises a first article of bedding; at least one flap attached along a first side thereof to the first article of bedding; an attachment mechanism attached to the flap; a complementary attachment mechanism attached to the first article of bedding, the attachment mechanism adapted to connect to the complementary attachment mechanism to form a pouch between the flap and the first article of bedding.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a bedding design that enables a user to fold a portion of the bedding underneath itself to create a pouch. The pouch may provide warmth for a user's feet and lower legs when they are lying in bed.

Figure 1:
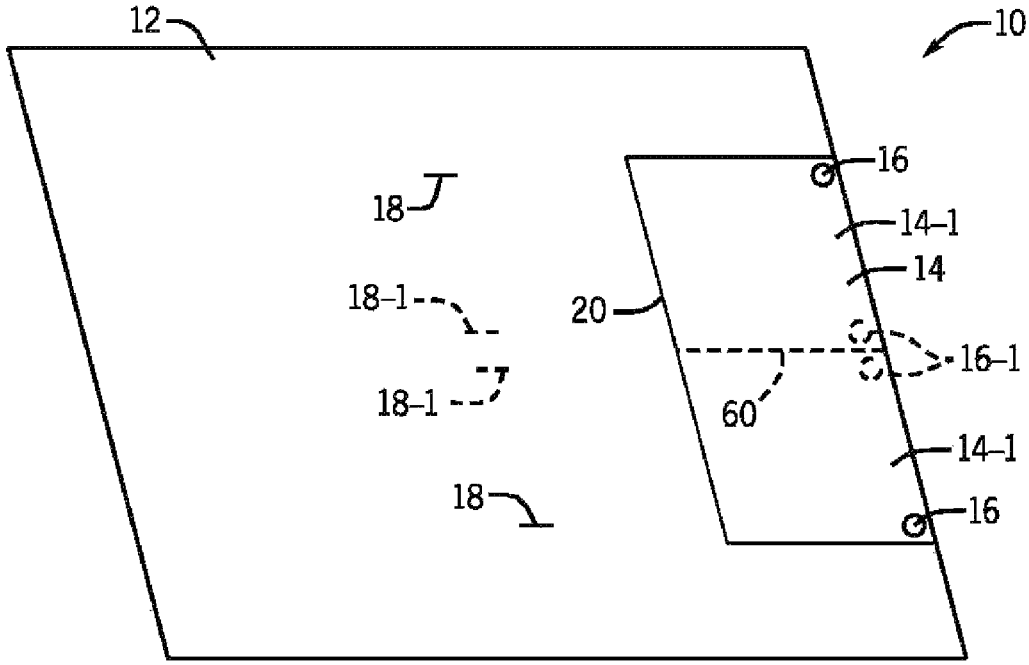
FIG. 1 is a perspective view of a bedding design according to an embodiment of the present invention.

Referring to FIG. 1, a bedding design 10 may include a bedding article, such as a comforter 12 that may include a flap 14 added thereto. The flap 14 may be disposed on the foot side of the comforter 12 and may hang over the foot of a mattress

Figure 4:
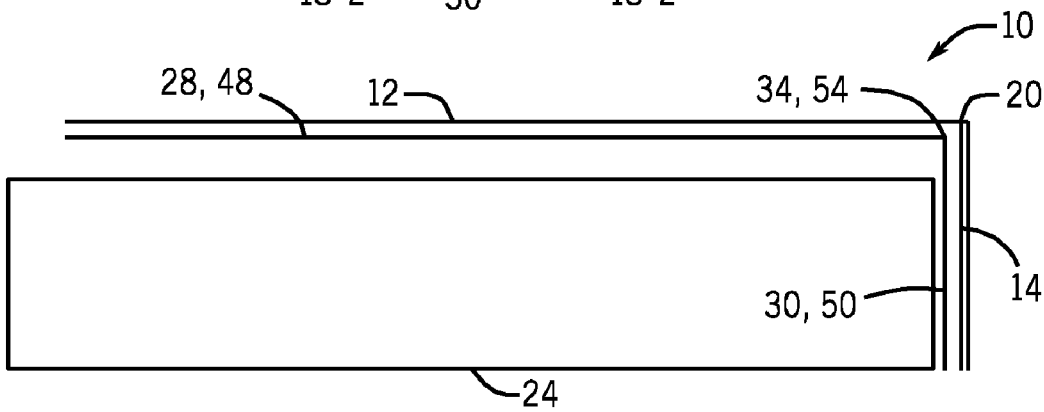
FIG. 4 is a cross-sectional view of the bedding design of FIGS. 1 and 3 in a non-use position.

24 when not in use (see FIG. 4). The flap 14 may be attached to the comforter 12 at a fold line 20. In one embodiment, the flap 14 may be the same material as the comforter 12 and may be sewn to the comforter 12 at the fold line 20. In other embodiments, the flap 14 may be a material different from the material of the comforter 12. In some embodiment, the flap 14 may span the width of the mattress 24. In some embodiments, the flap 14 may be smaller than the width of the mattress 24.

Figure 2:
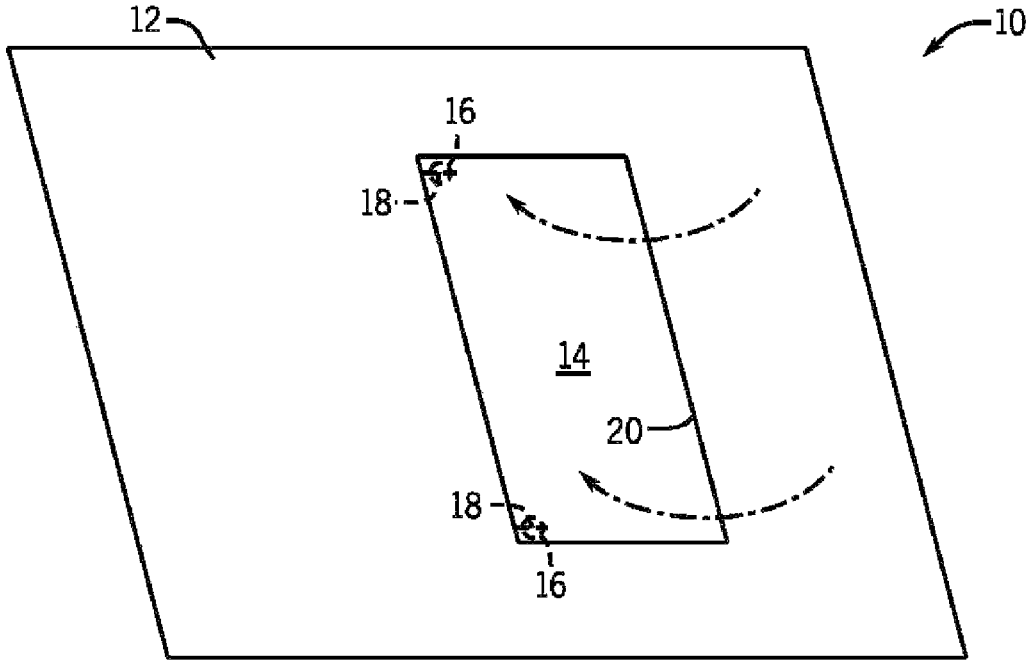
FIG. 2 is a perspective view of the bedding design of FIG. 1 is an in-use position.

Referring to FIG. 2, the comforter 12 may be used to provide additional warmth to a user by folding the flap 14, as shown by arrows in FIG. 2, so that an attaching mechanism, such as a button 16, on the flap 14 aligns with a corresponding attachment mechanism, such as a button hole 18, on the comforter 12. In its folded form, the comforter 12 includes a pouch where a user may place their feet to provide warmth thereto.

Figure 3:
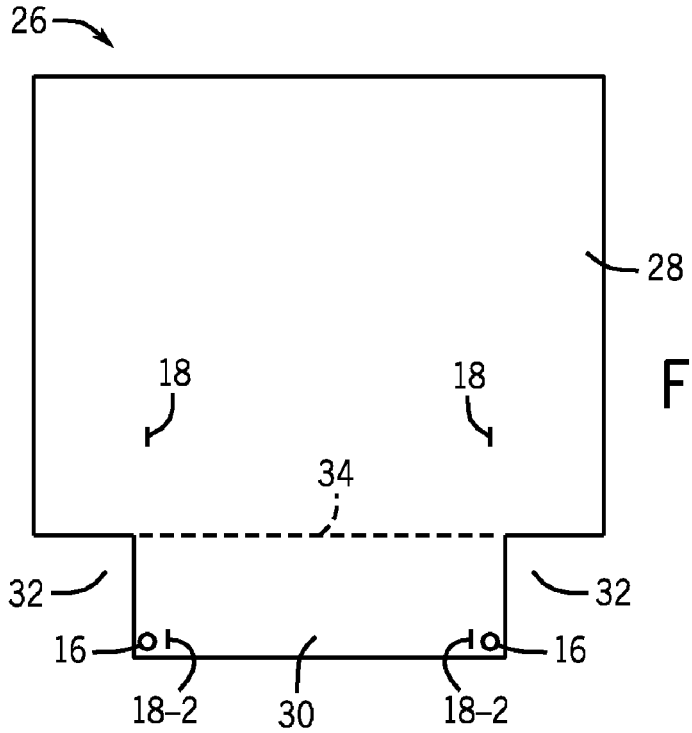
FIG. 3 is a plan view of a bedding design according to another embodiment of the present invention.

Referring to FIG. 3, in an alternate embodiment, a bedding design 26 may include a sheet or blanket 28 (hereinafter, simply referred to as sheet 28) that has its corners 32 removed. For example, rectangular cut-outs may be formed in two adjacent corners 32 to form a flap 30 in the sheet 28. In this embodiment the flap 30 may be formed from the sheet 28 and not from an additional piece of material attached to the comforter, as shown in FIGS. 1 and 2. Similar to the embodiment of FIG. 2, to use the sheet 28 to provide a pouch, the user may fold the sheet 28 along a fold line 34 and attach the buttons 16 into the button holes 18.

In the above embodiments, the attachment means for using the bedding design 10, 26 includes buttons 16 and button holes 18. Other attachment means may be contemplated within the scope of the present invention. For example, snaps, zippers, or hook and loop fasteners may be used to secure the flap 14, 30 in an in-use position.

Figure 5:
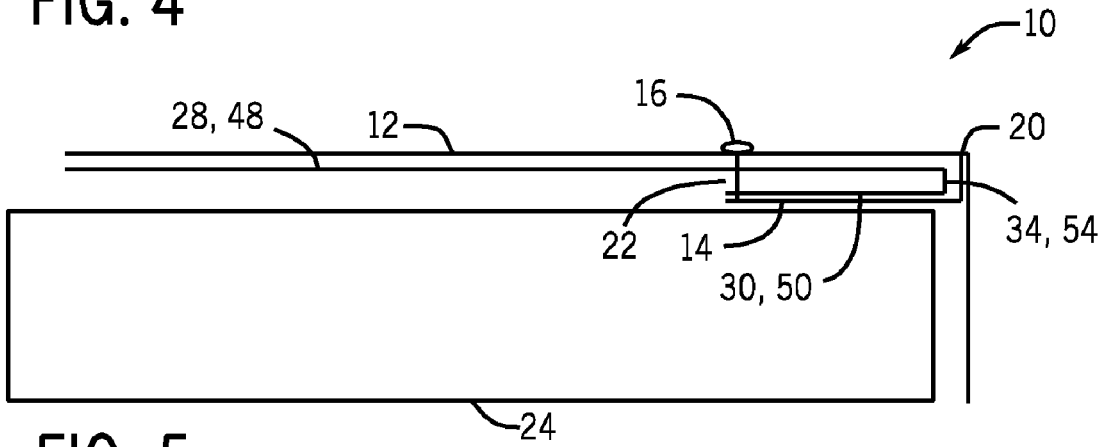
FIG. 5 is a cross-sectional view of the bedding design of FIGS. 1 and 3 in a use position.

The comforter 12 and the sheet 28 may be used by themselves, for example, on a bed or in a chair. Referring to FIGS. 4 and 5, the comforter 12 may be used in conjunction with the sheet 28. The sheet 28 may be placed on the mattress 24 and the comforter 12 may be placed on top of the sheet 28. To form the pouch, a user may fold the flap 14 of the comforter 12 together with the flap 30 of the sheet 28 to align the buttons 16 with the button holes 18. The pouch of the sheet 28 may be nested in the pouch of the comforter 12 to form a single pouch. As shown in FIG. 5, the sheet 28 may have holes 18-2 near the buttons 16 to pass the buttons 16 of the comforter 12 therethrough. In this manner, the buttons 16 of the comforter 12 may hold both the sheet 28 and the comforter 12 in an in-use position. In an alternate embodiment, the comforter 12 may contain additional button holes (not shown) so that both the flap 30 of the sheet 28 and the flap 14 of the comforter 12 may button into the button holes 18. As discussed above, other attachment means, as are known in the art, may be used to secure the flaps 14, 30 in the in-use position as shown in FIG. 5.

Referring to FIG. 5, when the bedding design 10, 26 is in an in-use position, the comforter 12 still appears as normal, even when the flap 14 of the comforter 12 is folded. This may allow the bed to appear "made" regardless of whether the bedding is in the non-use position (FIG. 4) or the in-use position (FIG. 5).

While FIGS. 4 and 5 show only the sheet 28 and the comforter 12 being used, additional bedding materials may be added. For example, a blanket, designed similar to sheet 28, may be positioned between the sheet 28 and the comforter 12.

Figure 6:
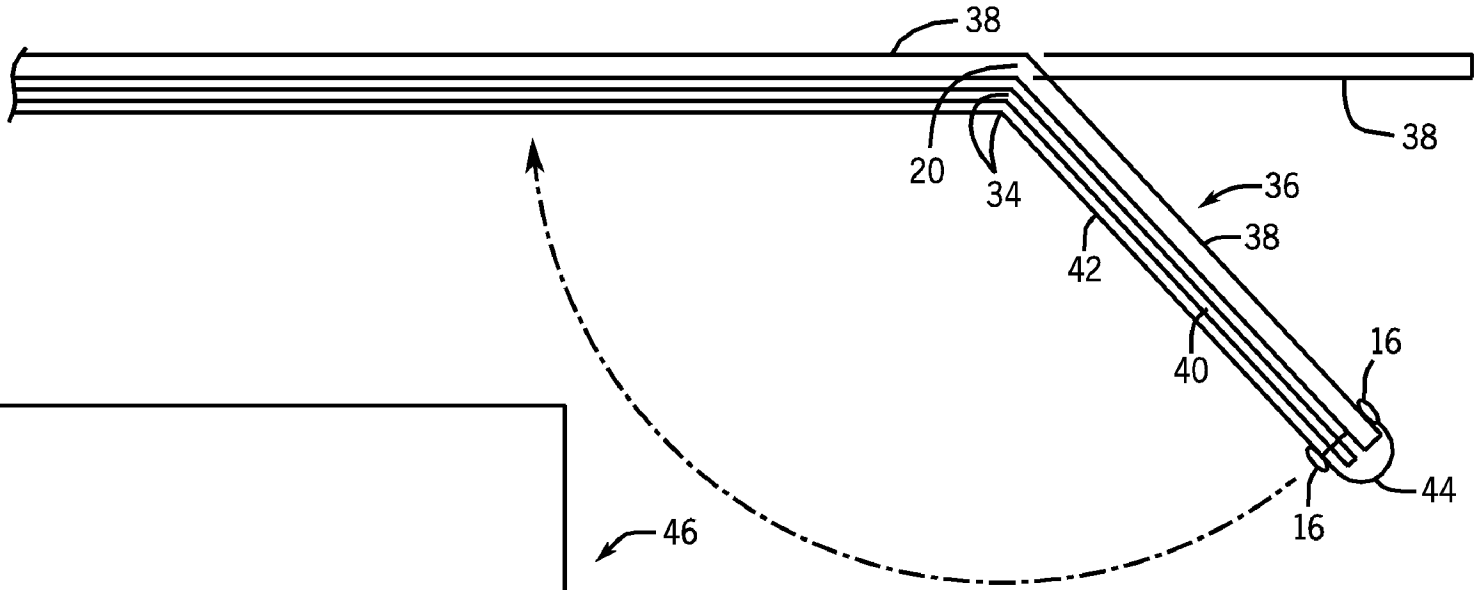
FIG. 6 is a cross-sectional view of a bedding design according a still another embodiment of the present invention.

Referring now to FIG. 6, in an alternate embodiment, a comforter 38 may be used with a sheet 42 and a blanket 40. Similar to that described above, the comforter 38 may fold upon itself, with the sheet 42 and the blanket 40 to form a pouch. In one embodiment, a flap 44 of material from the sheet 42 may extend beyond the length of the blanket 40 or the comforter 38. This flap 44 may be designed to wrap around the end of the bedding and connect to the comforter 38. In this configuration, when the bedding is in an in-use position and the user slides their legs into the pouch, the user can be assured that their legs are going into the pouch and are not being misdirected between, for example, the blanket and the sheet that form the pouch.

Figure 7:
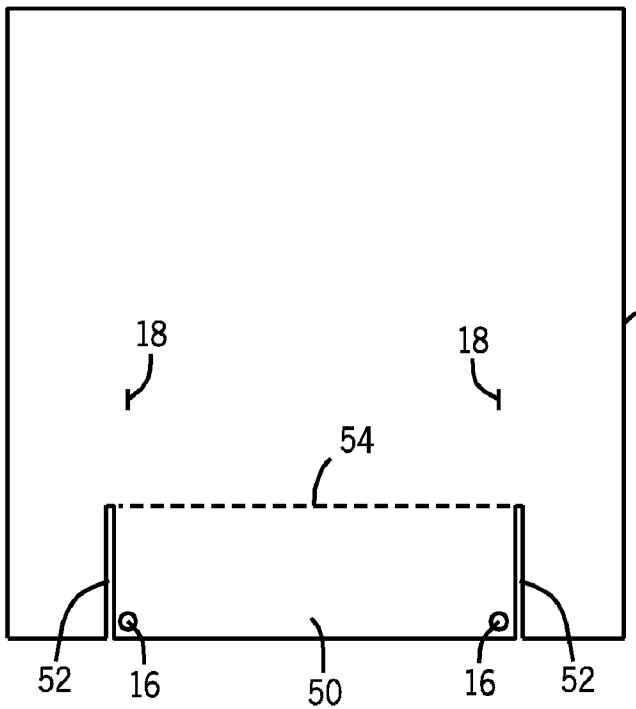
FIG. 7 is a plan view of yet another embodiment of the present invention.

Referring to FIG. 7, a bedding design 46 may include a sheet or blanket 48 (hereinafter referred to as sheet 48) may, instead of having its corners removed, as shown in FIG. 3, have slits 52 cut therein to define a flap 50. Similar to the embodiment of FIG. 3, the flap 50 may fold on a fold line 54 and attach onto itself to form a pouch.

While the above embodiments describe flaps 14, 30, 50 that may have a width about the same width as the mattress 24, the flaps 14, 30, 50 may be two substantially equal sized flaps. Referring back to FIG. 1, the dotted line 60 represents how the flap 14 may be divided into a first flap 14-1 and a second flap 14-2. These two flaps 14-1, 14-2 may be formed (positioned "in-use") independently by the user. Additional buttons 16-1 and button holes 18-1 may be provided to permit the separate attachment of the flaps 14-1, 14-2. The flaps 14-1, 14-2 may be sewn as two separate flaps. In one embodiment, the flaps 14-1, 14-2 may be capable of attaching to each other along the line 60 with, for example, a hook and loop fastener. This alternate embodiment may be especially useful for beds in which two people may sleep side-by-side, allowing each person the optionally of placing the pouch in-use on their respective side. A sheet and/or blanket, such as the sheet 28 of FIG. 3, may be configured similarly to the comforter 12 of FIG. 1. For example, the flap 30 of the sheet 28 may be divided into two flaps (not shown) that match the size of the flaps 14-1, 14-2 of the comforter 12.

It should be understood, of course, that the foregoing relates to exemplary embodiments of the invention and that modifications may be made without departing from the spirit and scope of the invention as set forth in the following claims.

What is claimed is:

1. A bedding system having a head end and a foot end, comprising:

a first article of bedding;

at least one flap attached along a first side thereof to the first article of bedding;

an attachment mechanism attached to the flap;

a complementary attachment mechanism attached to the first article of bedding, the attachment mechanism adapted to connect to the complementary attachment mechanism to form a pouch between the flap and the first article of bedding, the pouch positioned at least partially on top of a mattress at the foot end of the bedding system when the bedding system is disposed on the mattress, wherein the complementary attachment mechanism is located proximate to the foot end of the bedding system; and the pouch is formed on an underside of the first article of bedding, the pouch adapted to receive a user's feet.

2. The bedding system of claim 1, wherein the attachment mechanism is a button and the complementary attachment mechanism is a button hole.

3. The bedding system of claim 1, wherein the at least one flap is at least one rectangular flap, wherein the attachment mechanism is attached to corners of the flap opposite the first side of the flap.

4. The bedding system of claim 1, further comprising a second article of bedding, the second article of bedding adapted to be positioned between the first article of bedding and the mattress of a bed.

5. The bedding system of claim 4, wherein the first article of bedding is a comforter and the second article of bedding is a sheet or a blanket.

6. The bedding system of claim 4, wherein the second article of bedding has a rectangular shape with two adjacent corners removed by rectangular cut-outs, forming a second flap on the second article of bedding.

7. The bedding system of claim 6, wherein:

the second flap has a second attachment mechanism attached to the flap; and a second complementary attachment mechanism is attached to the second article of bedding, the second attachment mechanism adapted to connect to the second complementary attachment mechanism to form a second pouch between the second flap and the second article of bedding.

8. The bedding system of claim 7, wherein the pouch and the second pouch are nested to form a single pouch in the bedding system.

9. The bedding system of claim 4, further comprising a third article of bedding, the third article of bedding being positioned between the second article of bedding and the mattress, wherein the third article of bedding is a sheet and the second article of bedding is a blanket.

10. The bedding system of claim 4, wherein the second article of bedding has a rectangular shape with at least two slits cut into the second article of bedding along one edge thereof, the slits forming at least one second flap in the second article of bedding.

11. A bedding system comprising:

a first article of bedding;

at least one flap attached along a first side thereof to the first article of bedding;

an attachment mechanism attached to the flap;

a complementary attachment mechanism attached to the first article of bedding, the attachment mechanism adapted to connect to the complementary attachment mechanism to form a pouch between the flap and the first article of bedding, the pouch positioned at least partially on top of a mattress when the bedding system is disposed on the mattress; and a second article of bedding, the second article of bedding adapted to be positioned between the first article of bedding and the mattress of a bed, wherein:

the second article of bedding has a rectangular shape with two adjacent corners removed by rectangular cut-outs, forming a second flap on the second article of bedding;

the second flap has a second attachment mechanism attached to the flap;

a second complementary attachment mechanism is attached to the second article of bedding, the second attachment mechanism adapted to connect to the second complementary attachment mechanism to form a second pouch between the second flap and the second article of bedding; and the pouch and the second pouch are nested to form a single pouch in the bedding system.

12. A bedding system comprising:

a first article of bedding;

at least one flap attached along a first side thereof to the first article of bedding;

an attachment mechanism attached to the flap;

a complementary attachment mechanism attached to the first article of bedding, the attachment mechanism adapted to connect to the complementary attachment mechanism to form a pouch between the flap and the first article of bedding, the pouch positioned at least partially on top of a mattress when the bedding system is disposed on the mattress; and a second article of bedding, the second article of bedding adapted to be positioned between the first article of bedding and the mattress of a bed, wherein the second article of bedding has a rectangular shape with at least two slits cut into the second article of bedding along one edge thereof, the slits forming at least one second flap in the second article of bedding.

* * * * *